US006442970B1

(12) United States Patent
Dangelmayer et al.

(10) Patent No.: US 6,442,970 B1
(45) Date of Patent: Sep. 3, 2002

(54) EXPANDABLE BRACELET, IN PARTICULAR WATCH STRAP

(75) Inventors: Horst Dangelmayer, Remchingen-Singen; Elmar Brenk, Kaempfelbach, both of (DE)

(73) Assignee: ROWI Rodi & Wienenberger GmbH, Pforzheim (DE)

( * ) Notice: Subject to any disclaimer, the term of this patent is extended or adjusted under 35 U.S.C. 154(b) by 0 days.

(21) Appl. No.: 09/501,322

(22) Filed: Feb. 10, 2000

(30) Foreign Application Priority Data

Feb. 13, 1999 (DE) ..... 199 06 127

(51) Int. Cl.[7] ..... A44C 5/04
(52) U.S. Cl. ..... 63/5.1; 63/38; 59/79.3
(58) Field of Search ..... 63/5.1, 6, 38, 41; 59/79.1, 79.3

(56) References Cited

U.S. PATENT DOCUMENTS 3,066,475 A * 12/1962 Kunzmann
3,132,470 A * 5/1964 Kunzmann et al.
3,140,581 A * 7/1964 Hauser
3,494,123 A * 2/1970 Kremer
3,596,464 A * 8/1971 Bert ..... 59/79
3,609,962 A * 10/1971 Rieth
3,786,629 A * 1/1974 Rieth ..... 59/79 R
3,820,319 A * 6/1974 Abe ..... 59/79 R
4,999,990 A * 3/1991 Wong ..... 59/79.1
5,748,571 A 5/1998 Jackl

FOREIGN PATENT DOCUMENTS

| | | |
|---|---|---|
| DE | 1 078 798 | 3/1960 |
| DE | 1 145 410 | 10/1960 |
| DE | 1 190 234 | 8/1962 |
| DE | 1 557 630 | 6/1966 |
| DE | 1 557 471 | 4/1970 |
| DE | 2 819 710 | 5/1978 |

* cited by examiner

*Primary Examiner*—Anthony Knight
*Assistant Examiner*—Alison K. Pickard
(74) *Attorney, Agent, or Firm*—Browdy and Neimark

(57) ABSTRACT

An expandable bracelet composed of two layers of links placed on top of each other and cover elements which can be placed on and removed from an associated link of the upper layer of the bracelet by elastic deformation. Clip elements at the ends of each cover element cover the ends of the links at least essentially. The mechanical function portion of the bracelet is covered from the direction of the ends by this arrangement of the cover, and a visually closed appearance of the bracelet is achieved. The application of the cover element also assures a blocking effect on the links of the bracelet when lateral forces appear, so that an unintentional separation of the links is prevented.

7 Claims, 4 Drawing Sheets

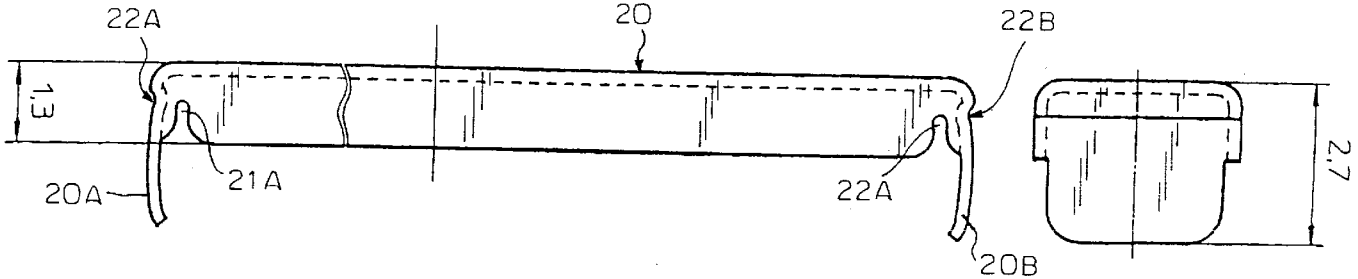
FIG. 3B
FIG. 3A
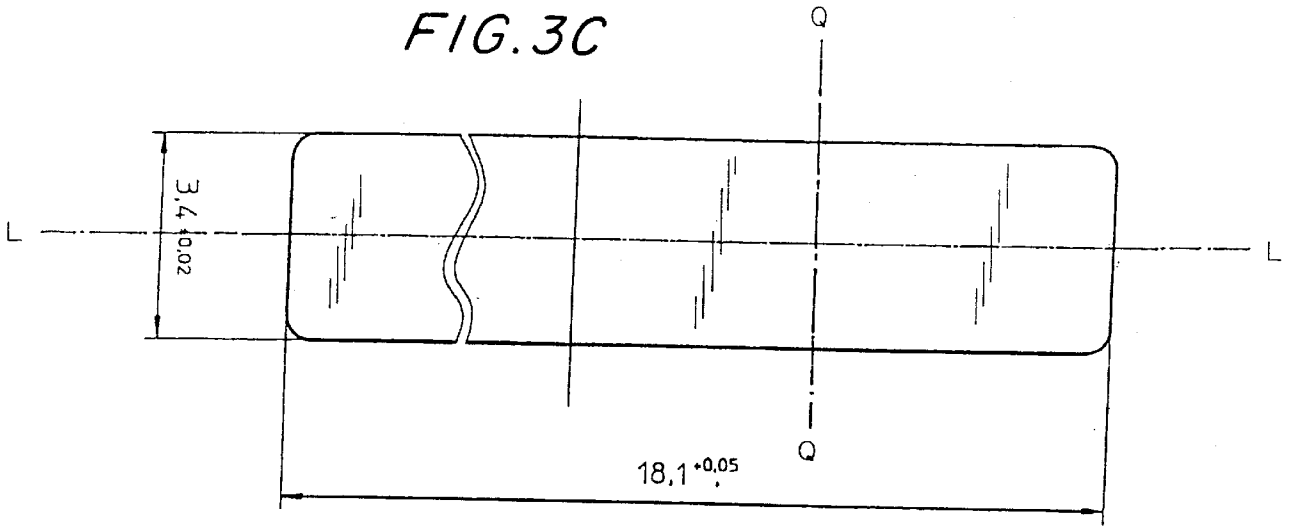
FIG. 3C

EXPANDABLE BRACELET, IN PARTICULAR WATCH STRAP

BACKGROUND OF THE INVENTION

The present invention relates to an expandable bracelet, or link strap, in particular a watch strap, consisting of two layers of links, the links of one layer being offset with respect to the links of the other layer in the direction of the length dimension of the bracelet, and the links being held together by connecting clips acting on the ends of the links in such a way that the links can be displaced relative to each other under tensional strain, wherein the links of the upper layer are each provided with a cover element having clip elements on the front.

Expandable bracelets have been known for some decades, one example thereof being disclosed in DE-PS 2 253 557. This reference discloses a double-layered link strap having an elaborate structure composed of heavy metal blocks which, for achieving a variable width of the bracelet, are pushed over the length of the bracelet onto the ends of the links, which are arranged on top of one another.

This solution has the advantage that an esthetic closed appearance of the link strap is possible also in the area of the ends, but it requires a large outlay of material, aside from the relatively complicated design of the links.

A bracelet of this type, described in DE-AS 15 57 471, has a decorative cap which can be pushed onto a hollow link of the upper layer of the link strap and is held on the end of the upper link by snap-in tongues. This arrangement requires a special design of the inside of the front portion of the decorative cap which, however, is not further described in the reference. The removal of the decorative cap is also not described therein, and the cover on the end only extends over the links of the upper layer.

BRIEF SUMMARY OF THE INVENTION

It is an object of the present invention to provide a novel expandable bracelet or link strap structure that is simpler and more cost-effective than prior art structures, wherein the covering of the ends of the links is possible, and which nevertheless makes possible a simple assembly and disassembly of the bracelet.

The above and other objects are achieved by the provision of an expandable bracelet composed of two layers of links placed on top of each other and cover elements which can be placed on and removed from an associated link of the upper layer of the bracelet by elastic deformation. Clip elements at the ends of each cover element cover the ends of the links at least essentially. The mechanical function portion of the bracelet is covered from the direction of the ends by this arrangement of the cover, and a visually closed appearance of the bracelet is achieved. The application of the cover element also assures a blocking effect on the links of the bracelet when lateral forces appear, so that an unintentional separation of the links is prevented.

One concept of the invention therefore rests in placing, or elastically applying, a continuous cover element onto each link of the upper layer of the bracelet, the cover element having end parts which form clip elements that extend over the ends of essentially both layers. This solution has the advantage that the "functional mechanical structure" of the link strap cannot be viewed from the direction of the edges of the strap and an esthetically attractive, visually closed appearance of the link strap is achieved.

In this connection it is particularly advantageous to construct the cover element to be elastically or resiliently deformable in such a way that a cover element can be snapped or clipped on an upper links of the link strap, wherein the type and solidity of this snap-on connection can be preselected by simple structural steps in the area of the end, while also taking the respective material of the cover element into consideration.

It is conceivable here for the cover element to be a metal element in the shape of a trough in particular, wherein it is possible to already preselect the design of the esthetic appearance of the link strap by the selection of the metal. With customary constructions, wherein undoing/separating the link strap is achieved by the parallel displacement of adjoining links, the clip elements which cover the sides of the bracelet allow a blocking action, so that this disassembly of the link strap is only possible if it is actually intended and not if (for example when winding or pulling off the watch) considerable lateral forces occur, which could unintentionally lead to the separation of links.

A preferred exemplary embodiment will now be explained in greater detail with reference to the drawings.

BRIEF DESCRIPTION OF THE DRAWINGS

FIGS. 3A, 3B and 3C are, respectively, a side elevational view, a front end view, and a top plan view of the cover element with dimensions indicated by way of example.

DETAILED DESCRIPTION OF THE INVENTION

Figure 1:
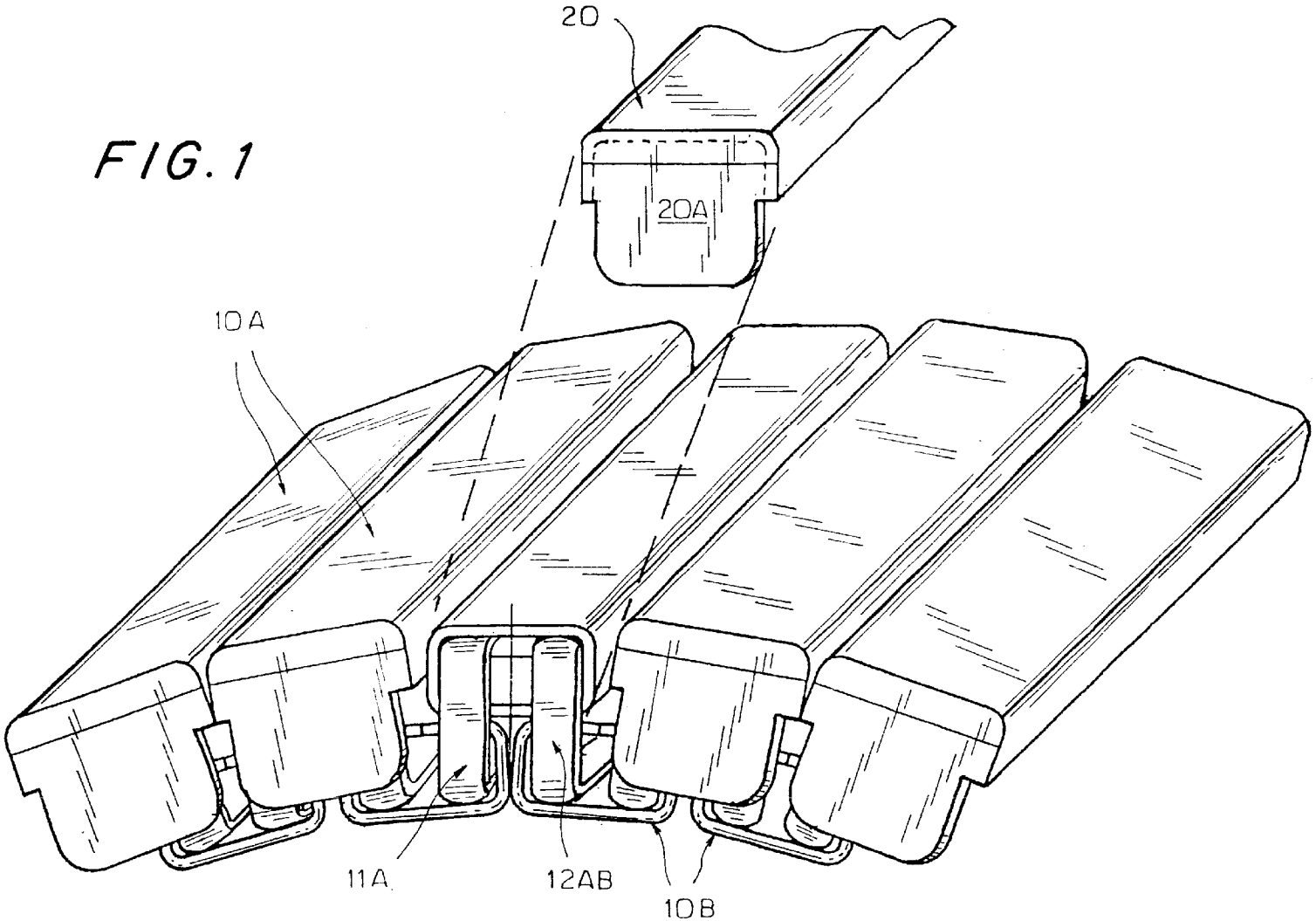
FIG. 1 is a perspective, partly exploded view of a section of a bracelet according to the invention with a cover element removed.
Figure 2B:
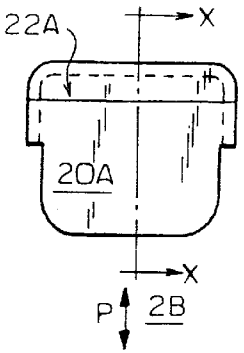
FIGS. 2A, 2B,2C and 2D are, respectively, a side view of one end of a cover element, a front end view of the cover element, a partial cross-sectional view along plane X—X of FIG. 2B of the cover element in the strap of FIG. 1, and a side view of the bracelet of FIG. 1 with one cover element removed.
Figure 2A:
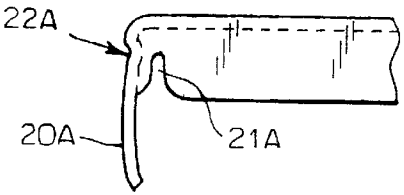
Figure 2D:
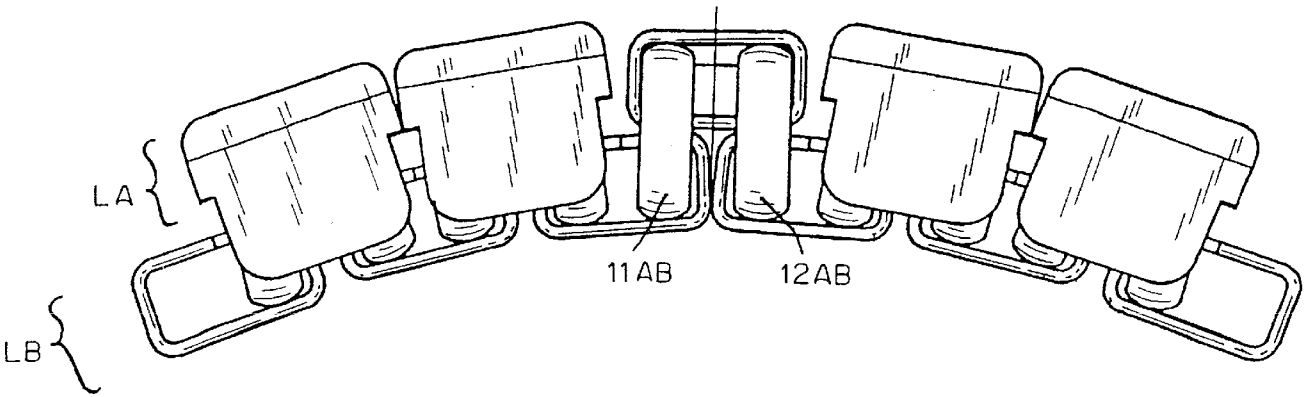

FIGS. 1 and 2D show a portion of an expandable bracelet, or strap, according to the invention. The portion shown has nine links 10, of which five links 10A constitute the top of the bracelet, i.e., the side which is visible from the outside, and four links 10B the underside, i.e., the side which rests on the wrist of the wearer, for example. The links 10A therefore constitute an upper layer LA, and links 10B constitute a lower layer LB of the link strap. The bracelet, or strap, has a length dimension that corresponds to the circumferential dimension of the bracelet when it is being worn on the wrist either as a simple bracelet or as a watch band. Successive links 10 are offset relative to one other by approximately half a link width, the link width being perpendicular to the length dimension.

Each of links 10A and 10B has a longitudinal dimension that extends perpendicular to the length dimension of the bracelet.

Figure 2C:
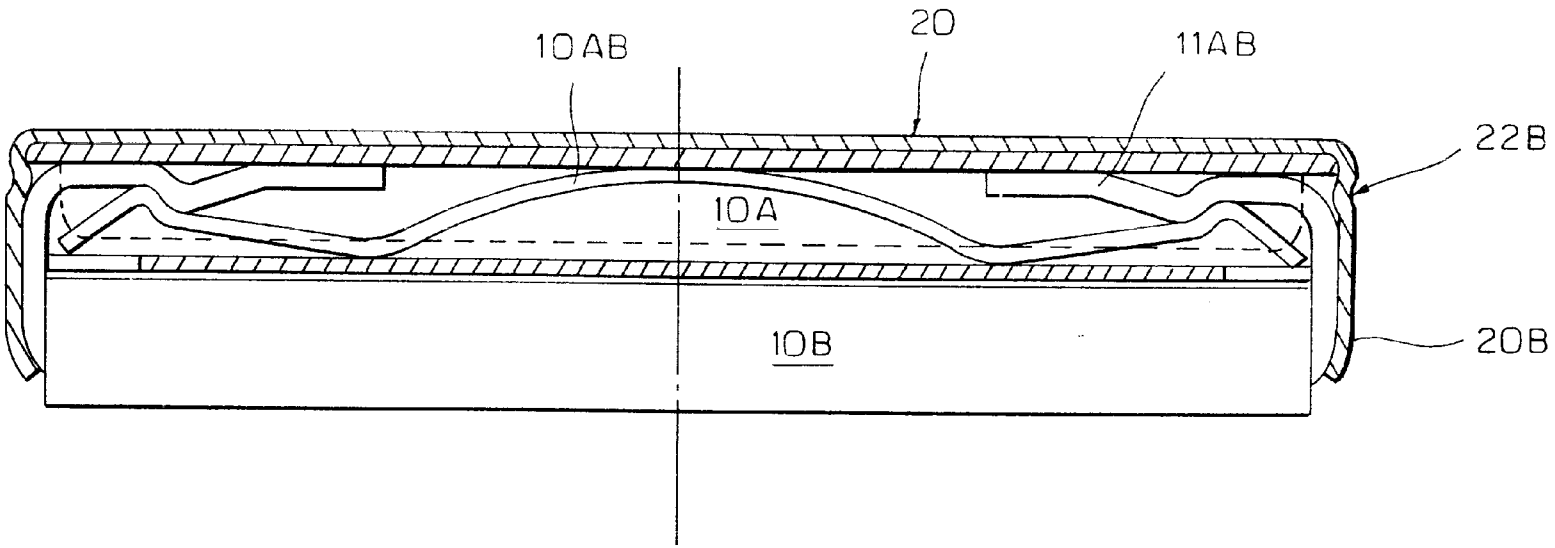

Connecting clips 11AB, 12AB provide connections between links 10A of upper layer LA and links 10B of lower layer LB. For this purpose, each connecting clip is formed as a U-shaped clamp, or "hairpin", having two legs connected together at one end by a cross-piece. Each leg extends into a respective link 10A or 10B and engages with a retention element 10AB, as can be seen in FIG. 2C in particular. Each retention element 10AB has a length and width corresponding to the length and internal width of a link and is mirror-symmetrical with respect to a center line of retention element 10AB. There is one retention element 10AB in each of links 10A and 10B retention element 10AB is held in place by being pressed between legs of associated clips 11AB, 12AB and a wall of the associated link 10A or 10B.

The basic structure of this connecting mechanism is known and therefore need not be explained in greater detail. It should be kept in mind that with this structural principle, disassembly can take place by pressing together links which are connected together by clips 11AB, 12AB and extracting one clip 11AB, 12AB at each side of the bracelet, for a total of two clips, so that the snap-in connection between the two opposite connecting clips 11AB, 12AB which respectively connect them, on the one hand, and elements 10AB, on the other hand, is released. Such disassembly can be aided by sliding one of the links, such as 10A, relative to its associated link, such as 10B, in the direction of the width of the bracelet, i.e., in the direction of axis L—L shown in FIG. 3C. With the solution in accordance with the invention, such disassembly can be performed only when a cover element 20 is removed form the link 10A, which will be explained below.

As shown in FIGS. 2A, 2B, 2C, 3A, 3B and 3C, each cover element 20 is a trough-shaped component made, for example, of sheet metal and having a U-shaped cross section both in the plane of its longitudinal axis L—L and in the plane of its transverse axis Q—Q, so that a trough-like structure results. The longitudinal ends of cover element 20 are formed as clip elements 20A, 20B which are dimensioned in such a way that each clip element 20A, 20B grips and covers the ends of the connecting clips 11AB, 12AB at one end of a respective link 10A and extends across links 10B at least far enough that an unintentional displacement of the links relative to one other in the direction of axis L—L, and therefore unintentional separation of the link bracelet, is no longer possible when cover elements 20 are in place.

The internal width of each cover element 20, in the direction of transverse axis Q—Q, here essentially corresponds to the external width, in the same direction, of each link 10A, so that each cover element 20 can be placed tightly and, as a rule without play, on its associated link 10A.

With the exemplary embodiment shown and in accordance with a preferred embodiment of the invention, the placement on top here is a catch or snap-in mechanism, which is achieved by means of the particular design of the cover element 20 in the area of the clip elements 20A, 20B.

Essentially, the inner contours of the clip elements 20A, 20B are matched to the exterior shape of the end areas of the connecting clips 11AB, 12AB, so that there is a close contact with the associated connecting clips 11AB, 12AB in the attached state of the cover element 20, such as can be seen in particular in FIG. 2C. Part of this close contact is a partial gripping around connecting clips 11AB, 12AB in such a way that attaching or removing a cover element is only possible with a resilient deformation of the clip elements 20A, 20B. The amount of this snap-in or spring action is originally determined by the type and the thickness of the material used for cover elements 20.

Two structural features are provided for obtaining a desired spring or snap-in behavior by these intended materials. One is constituted by notches 21A, 21B in the sides of cover elements 20 in proximity to clip elements 20A, 20B. The other is a channel-or groove-shaped crease 22A, 22B extending transversely over the end of the associated clip element 20A, 20B approximately at the height of the bases of notches 21A, 21B. By suitably dimensioning these two features, and with the predetermined characteristics of the material, it is possible to define the desired spring behavior, which must be determined to be such that, on the one hand, a solid hold of each cover element 20 on its bracelet link 10A is achieved and the unintentional release and a displacement of the links in respect to each other is prevented. On the other hand, the assembly and/or disassembly of a cover element 20, for example for inserting additional links for lengthening the bracelet, is possible without requiring elaborate tools.

Thus, embodiments of the invention have considerable advantages in design, as well as in technical respects. The total esthetic effect of a strap according to the invention is determined to a large degree by the character and the appearance of cover elements 20 which, regarding the material selection and surface appearance, open a large degree of design options to the designer. On the other hand, the "mechanical inner life" of the link strap, i.e. the design of the links 10, can be optimized with respect to the functionality of the link strap without regard to design requirements. In this case, the cooperation between cover elements 20 and connecting clips 11AB, 12AB is of particular value in the above described technical and structural view for preventing destruction or separation of the link strap.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An expandable bracelet, said bracelet having a length dimension and comprising: an upper layer of links; a lower layer of links which are offset with respect to the links of said upper layer in the direction of the length dimension of said bracelet; a plurality of connecting clips holding said links together in a manner to permit said links to be displaced relative to one another in the direction of the length dimension while said connecting clips undergo tensional strain; and a plurality of cover elements each having two opposed ends forming clip elements and each covering a respective link of said upper layer, wherein each of said links has a longitudinal dimension that is transverse to the length dimension and each of said links has two opposed ends that are spaced apart along the longitudinal dimension, each said cover element is mounted on the respective link of said upper layer by elastic deformation of said clip elements, said clip elements are resilient, said cover elements are removable from said links of said upper layer, and said clip elements at least essentially cover the ends of said links of both layers and said connecting clips.

2. The expandable bracelet in accordance with claim 1, wherein:

each said link of said upper layer has two longitudinal sides that extend between said ends of said link;

each said cover element has a U-shaped cross section in the direction of the length dimension of said bracelet and at least partially covers the two longitudinal sides of the respective link;

each said cover element has the form of a trough; and said clip elements project past said ends of said links of said upper layer.

3. The expandable bracelet in accordance with claim 1, wherein said clip elements at least partially cover said links of said lower layer to an extent sufficient to prevent separation of adjacent ones of said links from one another.

4. The expandable bracelet in accordance with claim 1, wherein:

each said link receives two of said connecting clips at each of said ends of said link; and when said cover elements are assembled to said links of said upper layer, said clip elements of each said cover element extend over said connecting clips which are received in the respective link.

5. The expandable bracelet in accordance with claim 4, wherein;

each said cover element has two longitudinal sides that cover the two longitudinal sides of the respective link;

the longitudinal sides of each cover element are provided, in proximity to each clip element, with a notch having a depth which influences a spring characteristic of said clip elements when said clip elements extend over said connecting clips.

6. The expandable bracelet in accordance with claim 4, wherein each said cover element has a top that extends between said longitudinal sides and said clip elements, and each said clip element is formed to have a crease which extends parallel to the top and which has a depth selected to impart a given spring characteristic to said clip elements.

7. The expandable bracelet in accordance with claim 6, wherein each notch has a base at a given distance from said top and said creases are positioned at the given distance from top.

* * * * *